US007077707B2

(12) United States Patent
Hyland et al.

(10) Patent No.: US 7,077,707 B2
(45) Date of Patent: Jul. 18, 2006

(54) MODULAR JACK CONNECTOR HAVING ENHANCED STRUCTURE

(75) Inventors: James H. Hyland, Hummelstown, PA (US); Kevin E. Walker, Hershey, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/913,050

(22) Filed: Aug. 5, 2004

(65) Prior Publication Data

US 2006/0030221 A1 Feb. 9, 2006

(51) Int. Cl.
*H01R 24/00* (2006.01)
*H01R 13/648* (2006.01)
*H01R 3/00* (2006.01)

(52) U.S. Cl. ..... 439/676; 439/489; 439/607

(58) Field of Classification Search ..... 439/676, 439/541.5, 607, 489, 677, 941, 954, 345
See application file for complete search history.

(56) References Cited

U.S. PATENT DOCUMENTS

| | | | | |
|---|---|---|---|---|
| 4,379,609 | A * | 4/1983 | Hardesty | 439/344 |
| 4,457,570 | A * | 7/1984 | Bogese, II | 439/59 |
| 4,874,330 | A * | 10/1989 | Bogese et al. | 439/418 |
| 5,456,619 | A | 10/1995 | Belopolsky et al. | |
| 5,478,261 | A * | 12/1995 | Bogese, II | 439/676 |
| 6,250,964 | B1 * | 6/2001 | Fair et al. | 439/607 |
| 6,419,526 | B1 * | 7/2002 | Fair et al. | 439/676 |
| 6,655,988 | B1 | 12/2003 | Simmons et al. | |
| 6,733,332 | B1 * | 5/2004 | Espenshade et al. | 439/541.5 |

* cited by examiner

*Primary Examiner*—Chandrika Prasad

(57) ABSTRACT

A modular jack connector (100) includes a housing (1) defining an inner space (10). A partition (11) is formed within the space. The partition forms with a plurality of fingers (12) and defines a plurality of slots (13) between two adjacent fingers. A plurality of contacts (321, 331) assembled to the housing. Each contact includes a contact engaging portion (3212, 3312) extending through the slots. At least one of the fingers and the contact engaging portions includes a reduced-dimension-portion such that clearance between the contact engaging portion and the slot is increased.

17 Claims, 11 Drawing Sheets

MODULAR JACK CONNECTOR HAVING ENHANCED STRUCTURE

BACKGROUND OF THE INVENTION

1. Field of the Invention

The present invention related to electrical connectors and more particularly, to a modular jack connector providing connection with plug connectors.

2. Description of the Prior Art

Modular jacks are often used in computers to interconnect the computers with electronic peripheral equipments. As multi-function trend becomes more popular in computer industry, while spaces on printed circuit boards (PCBs) of the computers are limited, stacked modular jacks have been widely adopted in electrical connectors. U.S. Pat. No. 6,655,988 B1, assigned to Tyco Electronics Corporation, discloses a modular jack assembly comprising an insulative housing defining a plurality of through-cavities in side-by-side fashion as two rows. Each cavity forms a partition therein dividing the cavity into a plug receiving space and a subassembly receiving space, respectively. Each plug receiving space is configured for receiving a mating plug and includes a pair of generally right-angle shaped tabs as performance of plug latch feature at a front face of the housing. Each subassembly receiving space is configured for receiving a subassembly to which a plurality of receptacle contacts are assembled, wherein each contact includes a contact engaging portion. Each partition includes comb-like contact aligning mechanism rendering the contact engaging portions of the receptacle contacts extending therethrough to electrically connect with corresponding plug contacts of the mating plug, thereby forming an electrical connection between the mating plug and the modular jack assembly.

Since there is inherent amount of clearance that is designed between the mating plug and corresponding cavity of the housing, when an external force, such as pulling or rotating, is exerted on plug cable connected with the mating plug, the mating plug tilts and angles itself within the plug receiving space. As the mating plug tilts, the receptacle contacts are pushed to one side by the plug contacts of the mating plug. However, the comb-like contact aligning mechanism of the cavity does not have enough space to allow the receptacle contacts to accept a side force and still retain its interface with the plug contacts. That is to say, the receptacle contacts lose free motion up and down to follow the plug contacts position such that it can interfere with ongoing process and interrupt data transfer, therefore the receptacle contacts disconnecting from the plug contacts causing discontinuity. More, as the mating plug tilts, resistive force is transferred to the plug retention tabs of the housing. Since the pairs of right-angle shaped tabs of the housing are inclined to stress concentration and are small, the strength of the tabs serving as a plug latch feature of the housing has become a concern.

Hence, an improved modular jack connector is needed to eliminate the above mentioned defects of conventional modular jack assemblies.

BRIEF SUMMARY OF THE INVENTION

Accordingly, a first object of the present invention is to provide a modular jack connector having enhancements to contact aligning mechanism of an insulative housing of the modular jack connector and contacts of the modular jack connector for achieving better performance under mating plug cable pulling and cable rotation.

A second object of the present invention is to provide a modular jack connector having strength enhancements to plug latch feature of an insulative housing of the modular jack connector for achieving better performance under mating plug cable pulling and cable rotation.

In order to achieve the object as set forth, a modular jack connector in accordance with the present invention includes an insulative housing defining a through cavity. A partition formed within the cavity divides the cavity into a plug receiving space and a terminal receiving space respectively. The partition of the housing forms with a plurality of fingers and defines a plurality of slots between two adjacent fingers. A terminal block includes a plurality of contacts assembled to the terminal receiving space. Each contact includes a contact engaging portion extending through the slots with at least a tip located into the slot. At least one of the fingers and the contact engaging portions includes a reduced-dimension-portion such that clearance between the contact engaging portion and the slot is increased. The plug receiving space is adapted for receiving a mating plug connector. Means for securing the plug connector within the plug receiving space is provided on the housing. The means includes a pair of retention tab formed on the housing and peripherally at each plug receiving space. More, the housing defines a first void and a second void at joints on rear and top of each retention tab where two surfaces intersect each other for decreasing the stress concentration and enhancing molded material flow.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE INVENTION

Figure 1:
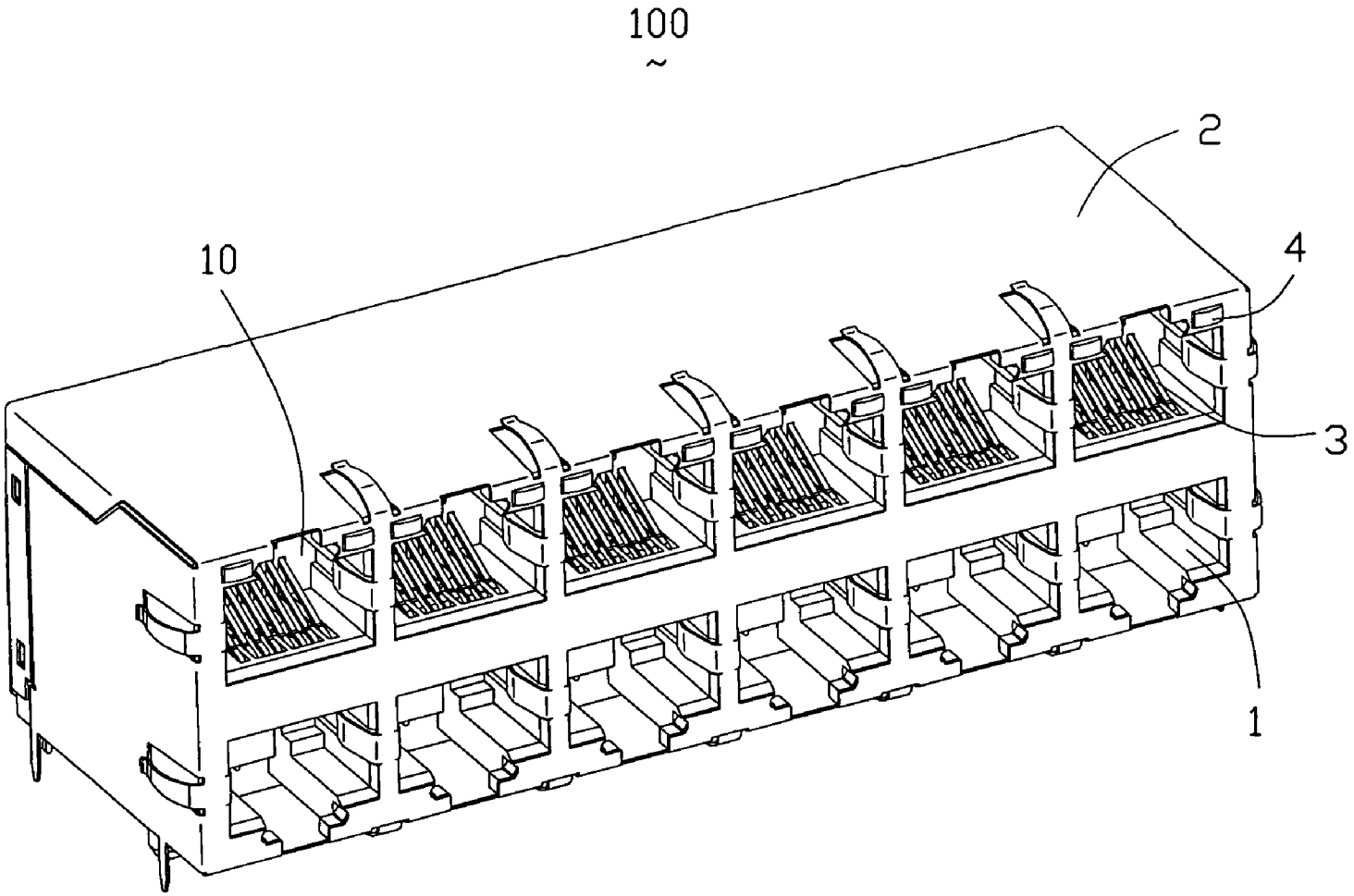
FIG. 1 is a perspective view of a modular jack connector in accordance with the present invention.
Figure 2:
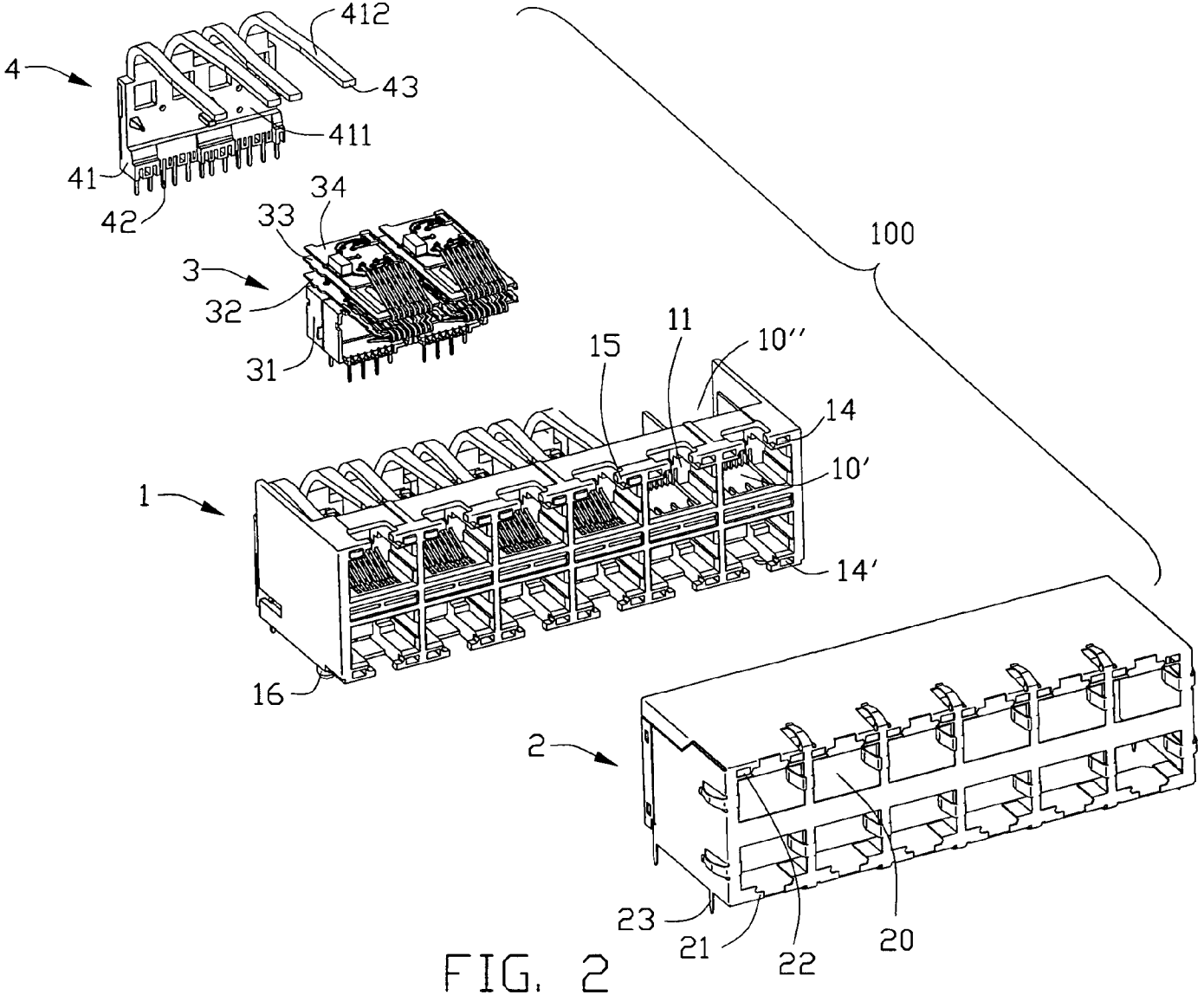
FIG. 2 is an exploded view of the modular jack connector of FIG. 1, wherein a pair of terminal blocks and corresponding LED module are taken out for clarity.
Figure 3:
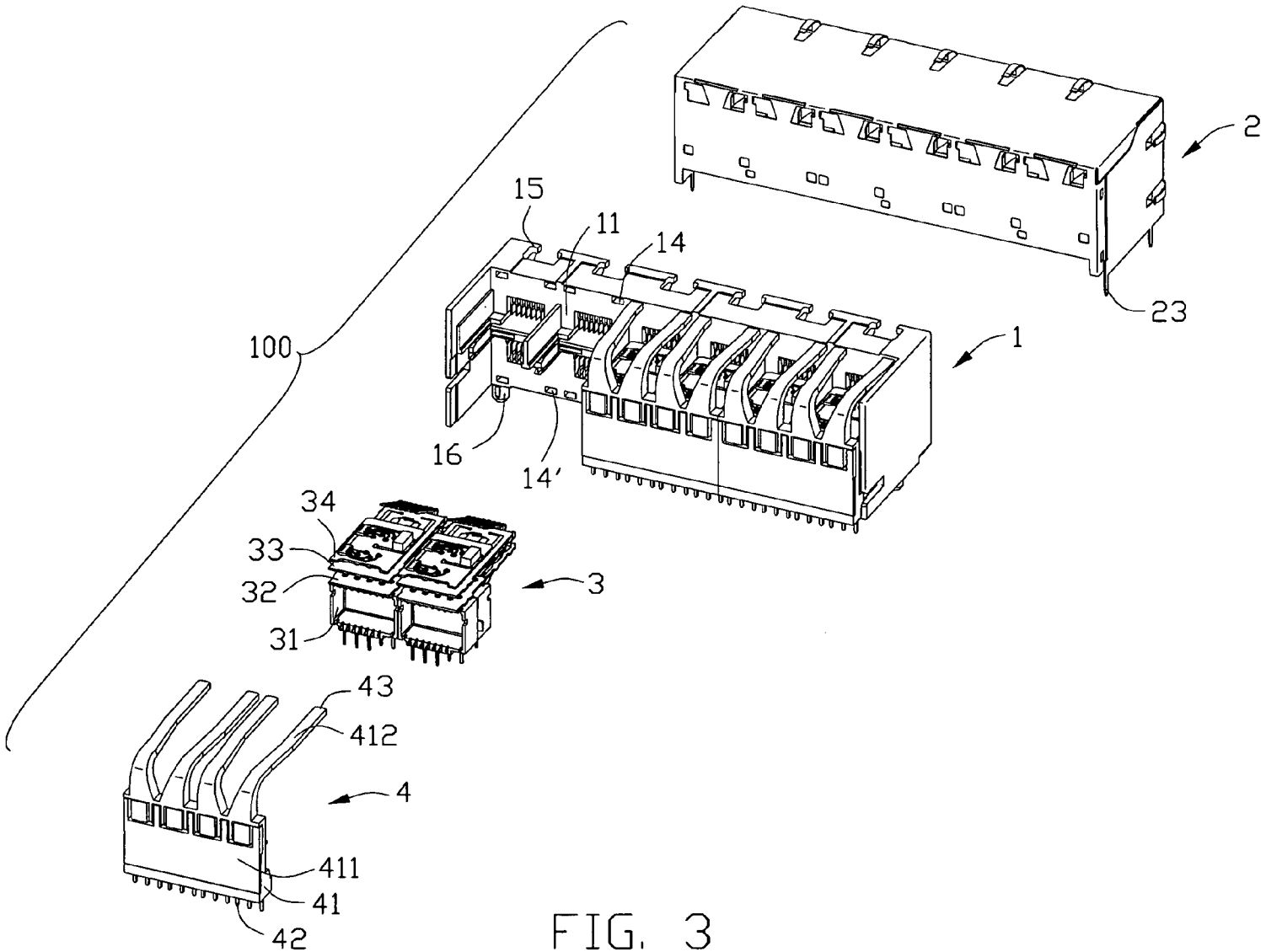
FIG. 3 is an exploded view of the modular jack connector similar to FIG. 2, but taken from another perspective.
Figure 4:
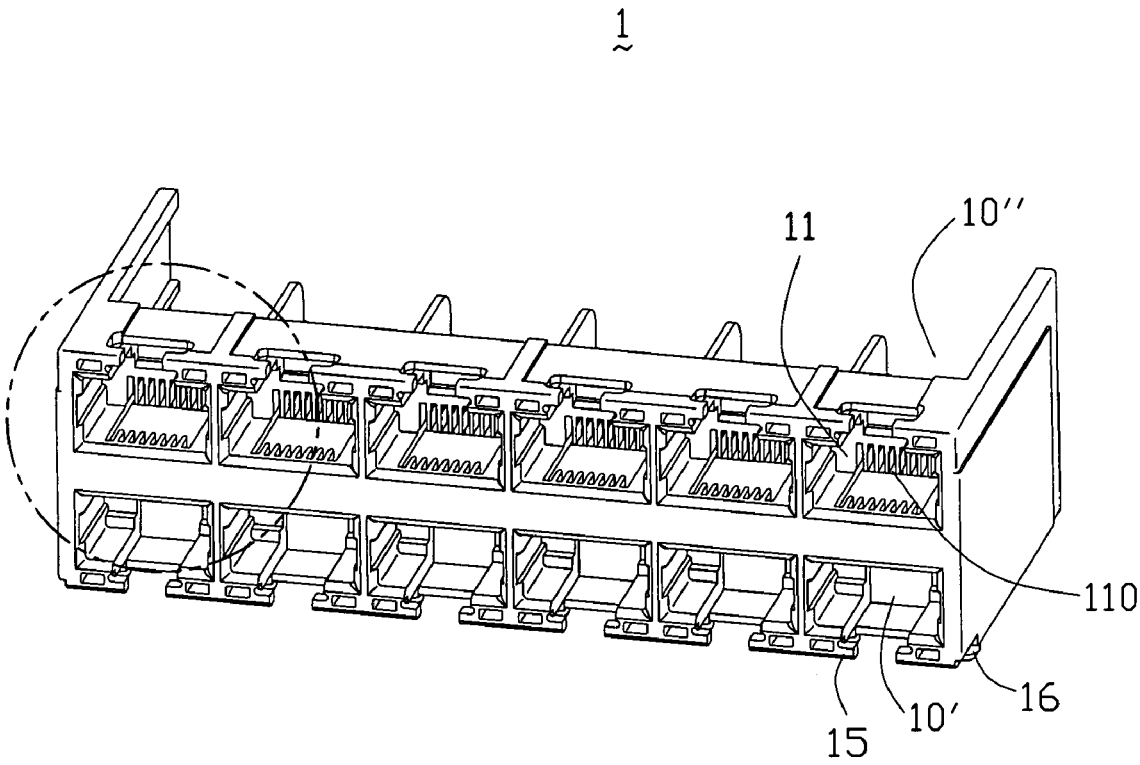
FIG. 4 is a perspective view of an insulative housing of the modular jack connector as shown in FIG. 2.
Figure 5:
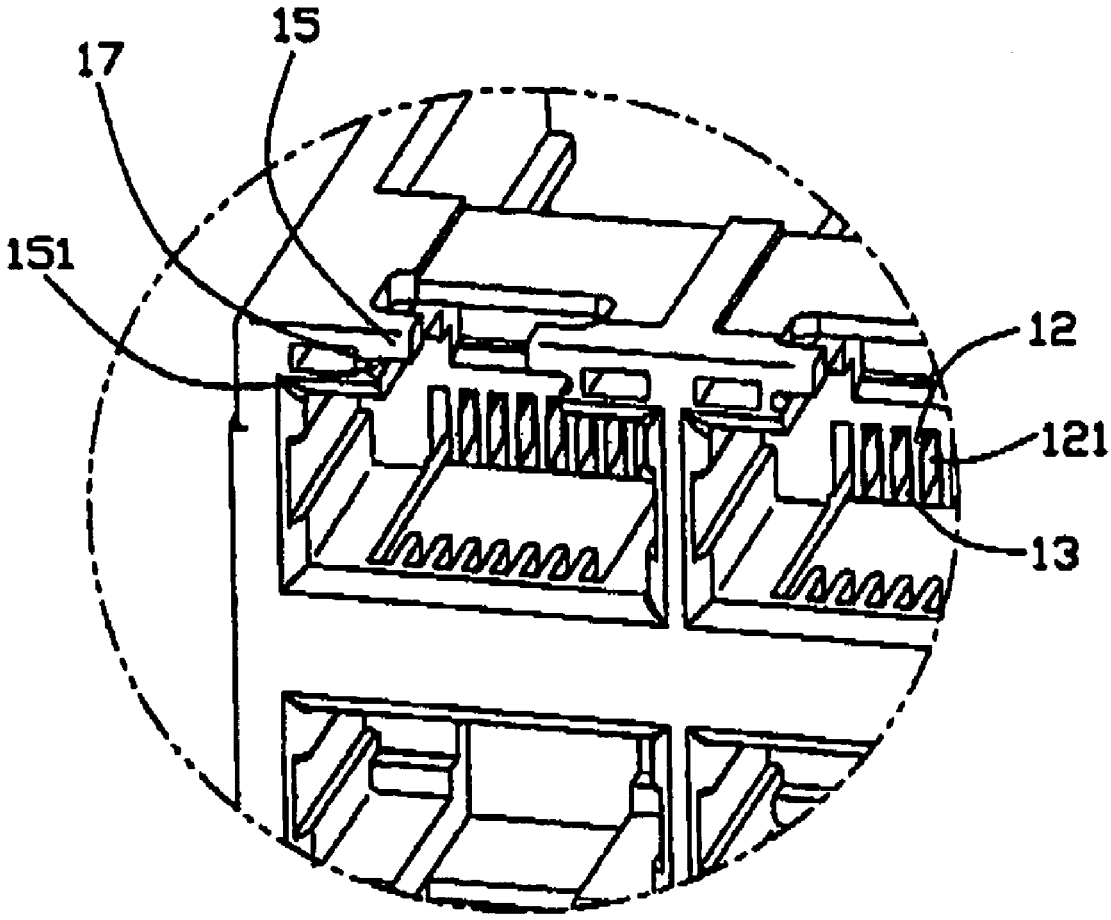
FIG. 5 is a partially enlarged perspective view taken from a dotted-line circle of FIG. 4.
Figure 6:
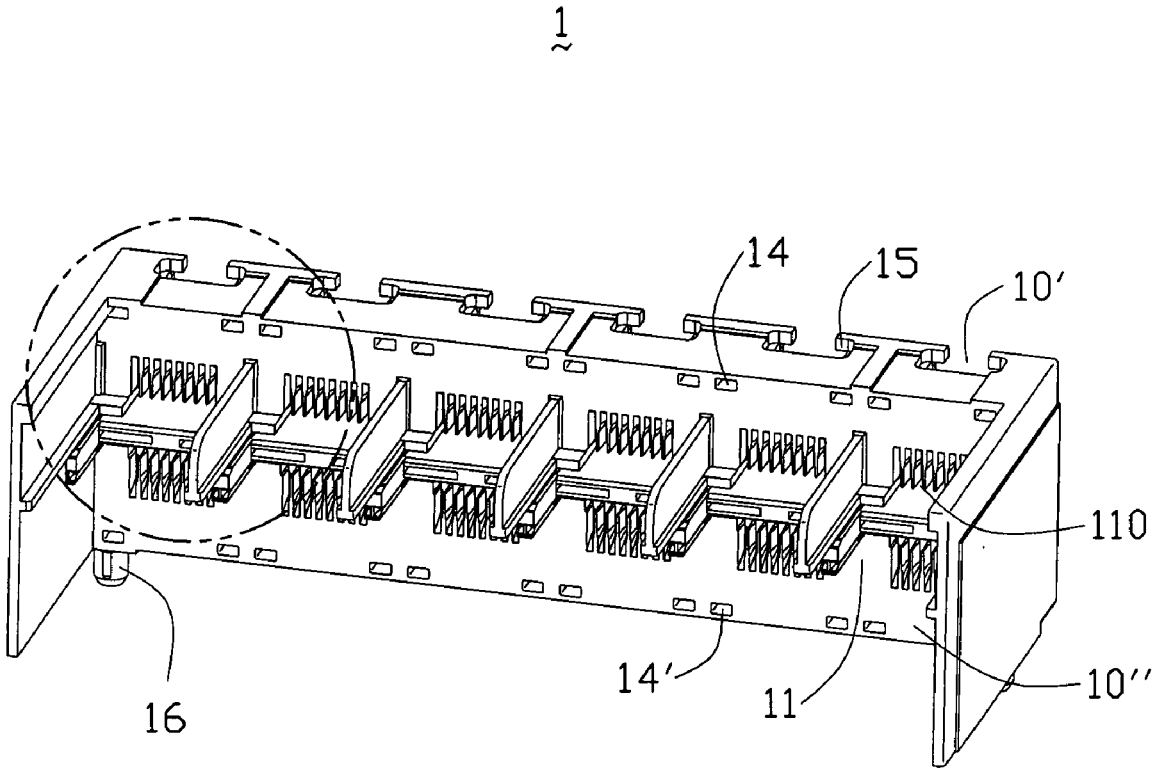
FIG. 6 is a perspective view of the housing of the modular jack connector similar to FIG. 4, but taken from another perspective.
Figure 7:
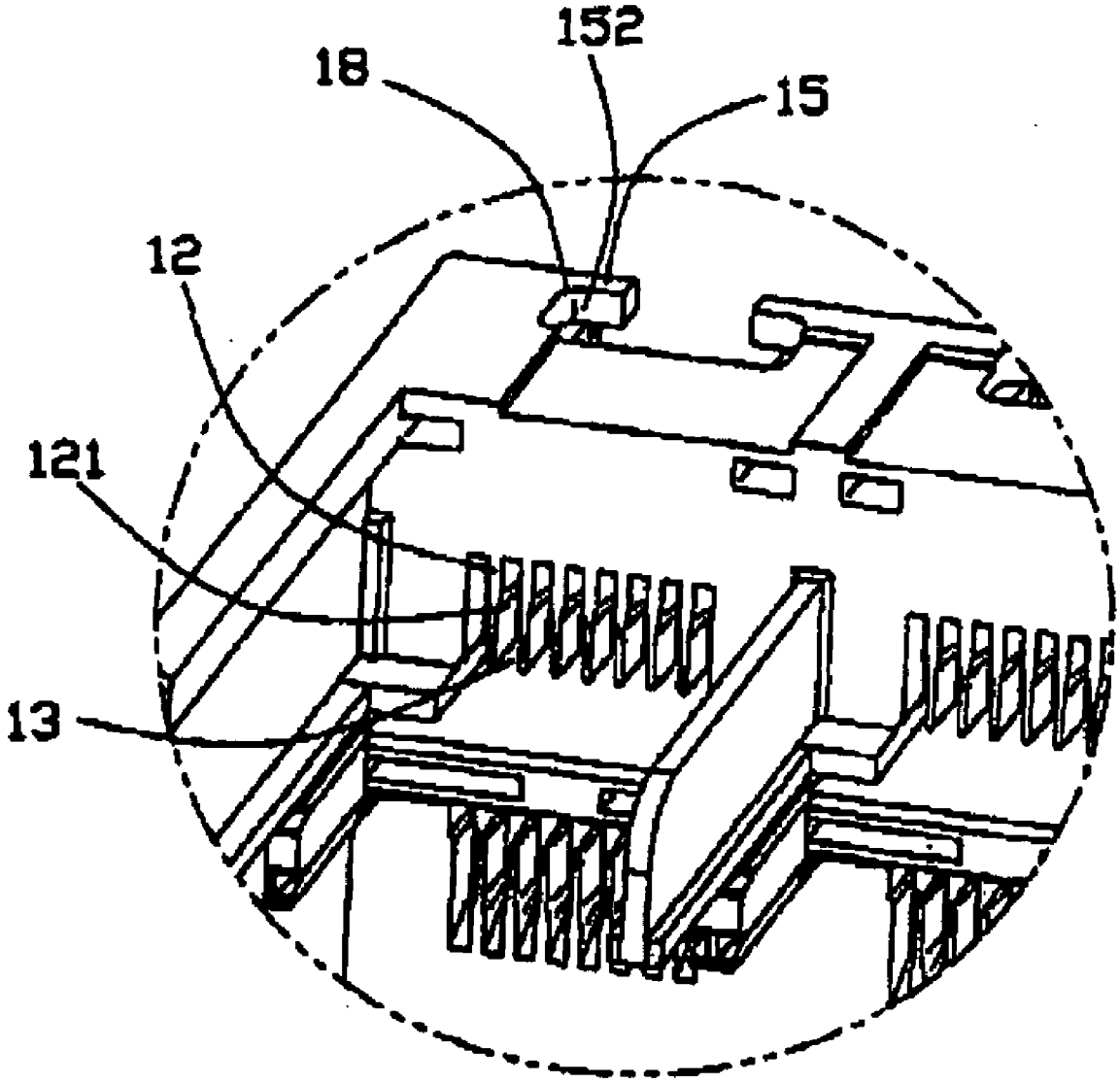
FIG. 7 is a partially enlarged perspective view taken from a dotted-line circle of FIG. 6.

Referring to FIGS. 1–3, a modular jack connector 100 in accordance with the present invention comprises an insulative housing 1, a terminal block 3 disposed within the housing 1, an Light Emitting Diode (LED) module 4 secured to the housing 1 for functioning as a visual indicator and a metal shield 2 optionally enclosing the housing 1 for Electromagnetic Interference (EMI) protection. The modular jack connector 100 in accordance with the present invention is a stacked modular jack assembly for high speed signal transmission.

Referring to FIGS. 4–7 in conjunction with FIGS. 1–3, the housing 1 defines a plurality of through cavities 10 in side-by-side fashion therethrough. Each cavity 10 forms upper and lower partitions 11 therein dividing the cavity 10 into plug receiving spaces 10' arranged as two rows, one disposed atop the other, in a front face and a terminal receiving space 10" in a rear face communicating with the plug receiving spaces 10', respectively. The plug receiving spaces 10' are each adapted to receive one mating plug (not shown) which has a plurality of electrical conductors disposed therein in a predetermined array. The terminal receiving spaces 10" are each adapted to receive the terminal block 3.

Each upper partition 11 within corresponding cavity 10 of the housing 1 defines a pass 110 with a plurality of fingers 12 extending downwardly and defines a plurality of slots 13 parallel space apart between two adjacent fingers 12. The fingers 12 of the upper partitions 11 each have a reduced-dimension-portion 121 at a lower distal end thereof to form a taper-shaped configuration, whereby the slot 13 between two adjacent fingers 12 is narrow between fixed ends of the adjacent fingers 12, while wide between distal ends of the adjacent fingers 12. The lower partitions 11 have the same configuration and are similar with corresponding upper partitions 11, so detailed description will be omitted hereinafter.

The housing 1 defines a pair of upper holes 14 and a pair of lower holes 14' respectively located at upper corners or lower corners of each upper or lower plug receiving space 10'. The upper and lower holes 14, 14' extend into the housing 1 and run through overall length of the plug receiving space 10', especially the upper holes 14 adapted for receiving the standard LEDs 4.

Also formed on the housing and peripherally at each plug connector space 10' of the housing 1 are a pair of retention tabs 15. The pair of retention tabs 15 are formed adjacent to entrance of a corresponding plug receiving space 10' and horizontally extend to each other as function of latching corresponding mating plug received therein. A generally cylindrical first void 151 and a generally cylindrical second void 152 are respectively defined at joints or corners 17, 18 (see FIGS. 5 and 7) where two pairs of adjacent perpendicular surfaces correspondingly intersect each other. The joint 17 forms at an inside corner below each retention tab 15 while the joint 18 forms at a rear corner behind each retention tab 15. It is noted that adding the first and second voids 151, 152, that is, adding a large radius to the retention tabs 15 serves to enhance moldflow and greatly reduces the stress concentration of the housing 1 where two perpendicularly adjacent surfaces intersect each other, thereby increasing strength of the retention tabs 15. In addition, the housing 1 has a pair of positioning posts 15 downwardly extending from bottom face for being received in corresponding holes of a mother board (not shown) on which the modular jack connector 100 is to be mounted.

The shield 2 is shaped to enclose the housing 1 and defines upper and lower openings 20 in side-by-side fashion arranged as two rows corresponding to the cavities 10 of the housing 1. The shield 2 has a mating face which is profiled as the front face of the housing and a pair of shielding blades 21 are formed at opposite upper corners of each upper opening 20 of the mating face. A pair of windows 22 are defined through the pair of the shielding blades 21 respectively corresponding to the upper holes 14 of the housing 1. More, a plurality of solder tails 23 are provided by stamping and extend downwardly from bottom edges of the shield 2. It is noted that the mating face of the shield 2 utilizing the shielding blades 21 which are profiled to cover front face of the retention tabs 15 for support protection and adding strength.

Figure 8:
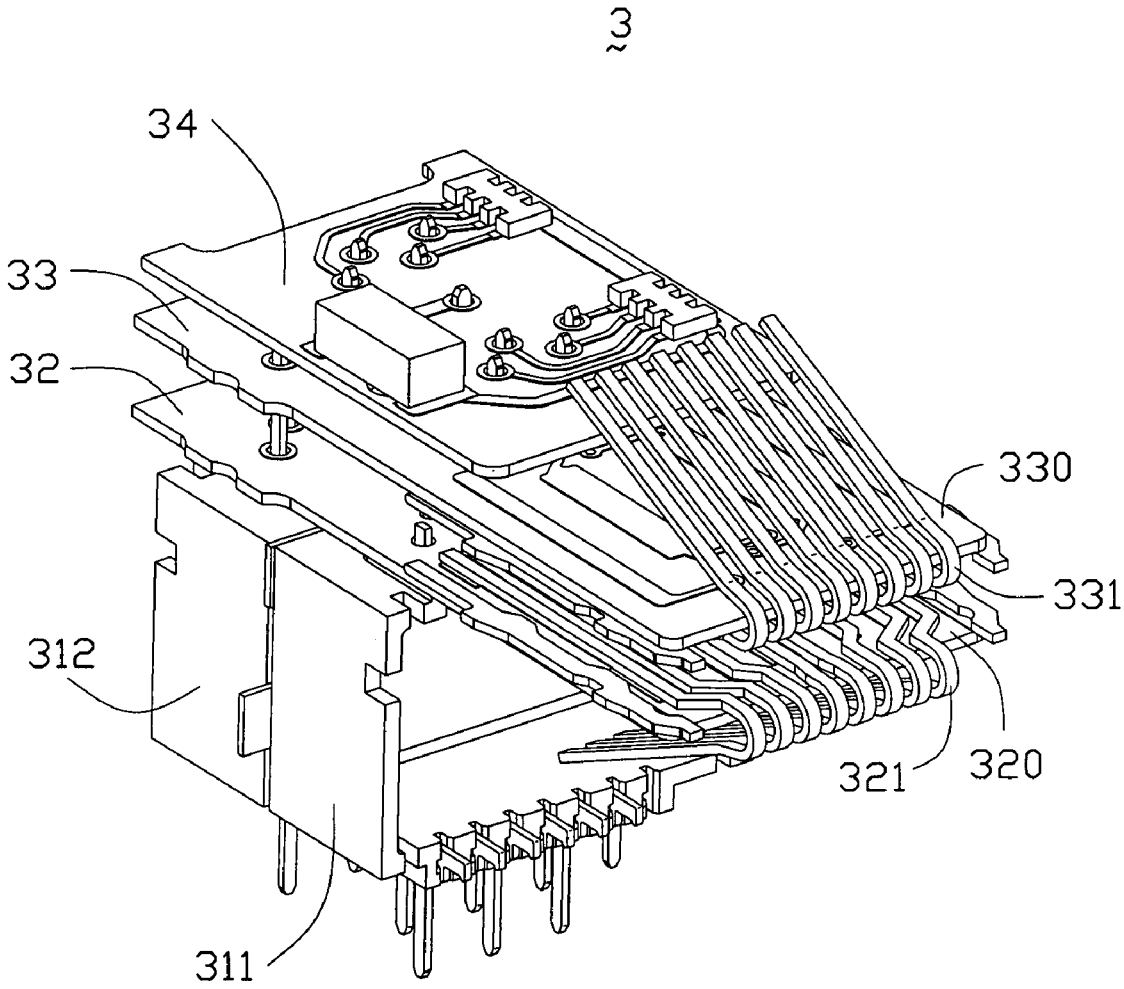
FIG. 8 is a perspective view of the terminal block of the modular jack connector as shown in FIG. 2.
Figure 9:
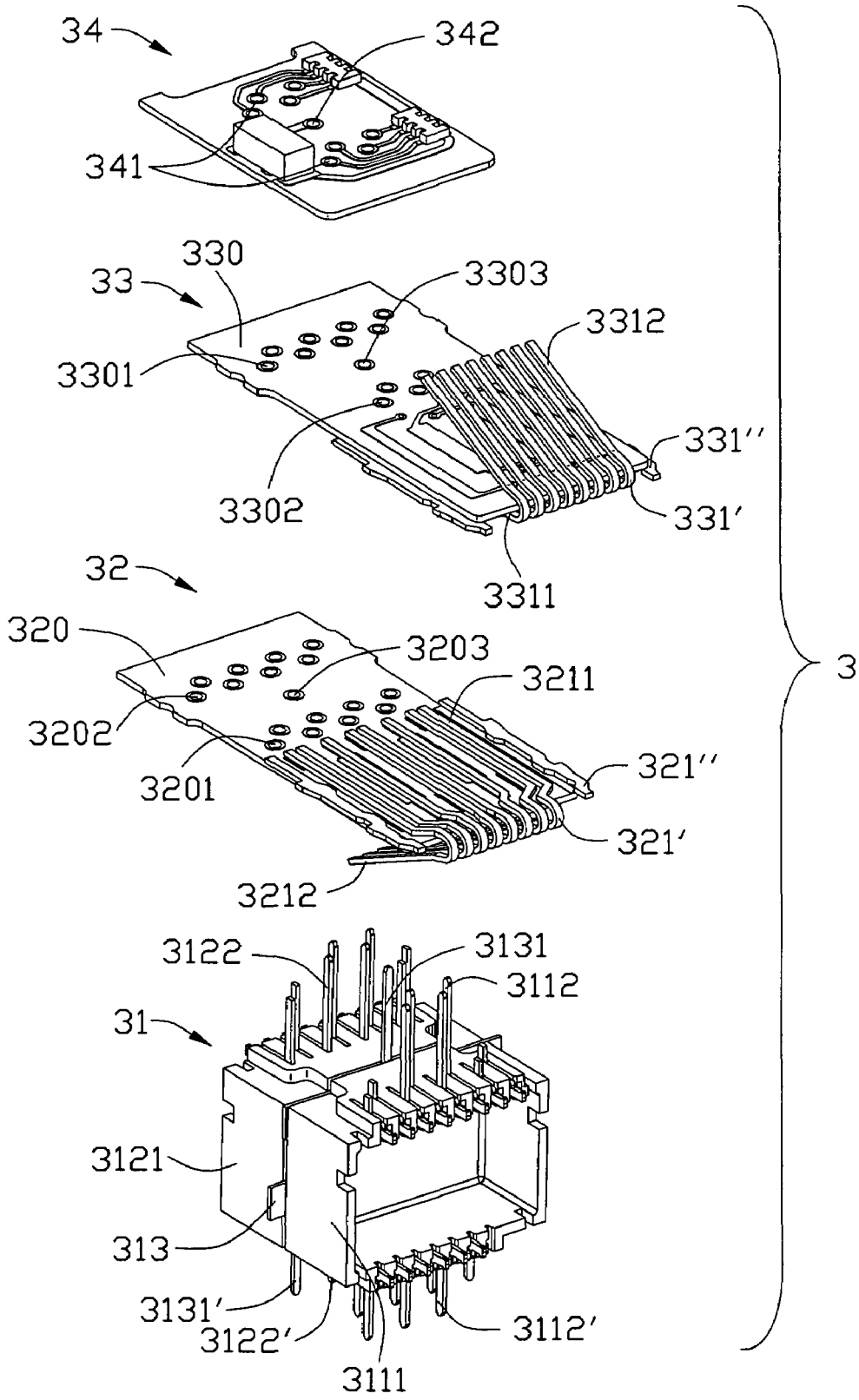
FIG. 9 is a partially-exploded view of the terminal block as shown in FIG. 8.

Referring to FIGS. 8 and 9, the terminal block 3 includes a magnetic module assembly 31, upper and lower contact array assemblies 32, 33 positioned above the magnetic module assembly 31, and a third printed circuit board 34 disposed above the upper contact array assembly 33.

The magnetic module assembly 31 includes front and rear magnetic modules 311, 312 and a metal plate 313. The front and rear magnetic modules 311, 312 are located back to back and are near identical in structure. The front and rear magnetic modules 311, 312 each includes a container 3111, 3121, upper and lower pins 3112, 3122, 3112', 3122' respectively disposed on upper and lower portions of the container 3111, 3121, and a plurality of magnetic coils (not shown) housed within the container 3111, 3121 to couple the upper and lower pins 3112, 3122, 3112', 3122'. The metal plate 313 is sandwiched between the front and rear magnetic modules 311, 312 and electrically shields and isolates the front and rear magnetic modules 311, 321. The metal plate 313 has upper and lower legs 3131, 3131' aligned with corresponding upper and lower pins 3112, 3122, 3112', 3122' of the front and rear magnetic modules 31, 312.

The upper and lower contact array assemblies 32, 33 are similar in structure. The upper and lower contact array assemblies 32, 33 have first and second printed circuit boards (PCB) 320, 330 respectively and first and second contact arrays 321, 331 soldered on the first and second PCBs 320, 330 respectively. The first and second contact arrays 321, 331 include respective first and second signal contacts 321', 331' and respective first and second side conductors 321", 331" each with barbs formed thereon. The first and second signal contacts 321', 331' have solder portions 3211, 3311 soldered on solder pads (not labeled) of the first and second PCBs 320, 330, and mating portions 3212, 3312 extending from the first and second solder portions 3211, 3311 and being angled rearwardly from respective first and second front edges of the first and second PCBs 320, 330 to be located above and below upper and lower faces of the first and second PCBs 320, 330 on which conductive traces (not labeled) are formed. The solder pads to which the first and second contact arrays 321, 331 are soldered, and the conductive traces are so designed and arranged that on the first and second PCBs 320, 330 are not only signal transmission but also they can affect cross-talk within the first and second contact arrays 321, 331, respectively.

The first and second PCBs 320, 330 respectively define first and second solder holes 3201, 3301, first and second clear holes 3202, 3302 and fist and second clear apertures 3203, 3303 therein. The third PCB 34 contains a plurality of signal conditioning components (not labeled) such as capacitors and resistors used for signal conditioning and termination. The third PCB 34 defines a plurality of third solder holes 341 and a third solder aperture 342 therein.

The upper pins 3112 of the front magnetic module 311 is solder to the first solder holes 3201 of the first PCB 320 and electrically connected with the lower contact array 321 by wires (not labeled) on the first PCB 320, and part of them further extend penetrate through the clear holes 3302 of the second PCB 330 to be soldered to the third solder holes 341 of the third PCB 34. The upper pins 3122 of the rear magnetic module 312 penetrate through the clear holes 3202 of the first PCB 320 to be soldered to the second solder holes 3301 of the second PCB 330, and then part of them further extending to be soldered to the third solder holes 341 of the third PCB 34. At the same time, the upper legs 3131 of the metal plate 313 penetrates through the first and second clear apertures 3203, 3303 of the first and second PCB 320, 330 to be soldered to the third solder aperture 342 of the third PCB 34. The first and second upper pins 3112, 3122 of the front and rear magnetic modules 311, 312 are connected to the capacitors and the resistors via circuit traces (not labeled) on the third PCB 34.

The LED module 4 includes an insulative carrier 41 with leads 42 overmolded therein and a pair of standard LEDs 43 electrically connecting with the leads 42. The carrier 41 has a base portion 411 and a pair of limbs 412 forwardly perpendicularly extending from a top edge of the base portion 411. The leads 42 downwardly extend beneath a bottom edge of the base portion 411 for soldering to the motherboard.

In assembly, the terminal blocks 3 are inserted into the housing 1 through the terminal receiving space 10" in the rear face of the housing 1. The first and second PCBs 320, 330 of the upper and lower contact array assemblies 32, 33 of the terminal block 3 move forwardly respectively until the first and second mating portions 3212, 3312 of the first and second signal contacts 321', 331' of the first and second contact arrays 321, 331 extend through the slots 13 of the upper and lower partitions 11 and enter into the upper and lower plug receiving spaces 10' of the housing 1 with tips of the first and second signal contacts 321', 331' located into the slots 13. The rear portions of the first and second PCBs 320, 330, the magnetic module assembly and the third PCB 34 are disposed in the terminal receiving spaces 10" of the housing 1. During this procedure, the first and second side conductors 321", 331" on the first and second PCBs 320, 330 slide into corresponding channels (not labeled) on both sides of the housing 1 for positioning and guiding the upper and lower contact array assemblies 32, 33. Therefore, the terminal blocks 3 are accurately inserted into the housing 1. The shield 2 then encloses the housing 1 for EMI protection and utilizes the shielding blades 21, which are profiled to cover front face of the retention tabs 15 for support protection and adding strength. The LED modules 4 are fixedly within the housing 1. The limbs 412 of the LED modules 4 are received in the upper holes 14 of the housing 1 and corresponding windows 22 of the shield 2 such that the LED 43 can be visible form the front face of the housing 1. The base portions 411 of the LED modules 4 abut against a rear wall of the shield 2, whereby the housing 1, the shield 2, the terminal blocks 3 and the LED modules 4 are tightly assembled as the modular jack connector 100 as best shown in FIG. 1.

In the present invention, the housing 1 defines the first and second voids 151, 152 at the joints where two surfaces intersect each other on rear and top of each retention tab 15 greatly reducing the stress concentration, thereby increasing strength of the retention tab 15. More, the fingers 12 within the cavities 10 of the housing 1 each employs the reduced-dimension-portion 121 to form the taper-shaped configuration such that the slot 13 is narrow at fixed ends between two adjacent fingers 12, while wide at distal ends between two adjacent fingers 12, thereby increasing clearance defined between the contact engaging portion 3212, 3312 of each signal contact 321', 331' and corresponding slot 13 of the housing 1. The first and second signal contacts 321', 331' can pivot further without binding the fingers 12 when an external force, such as pulling or rotating, brings force on the plug connectors.

Figure 10:
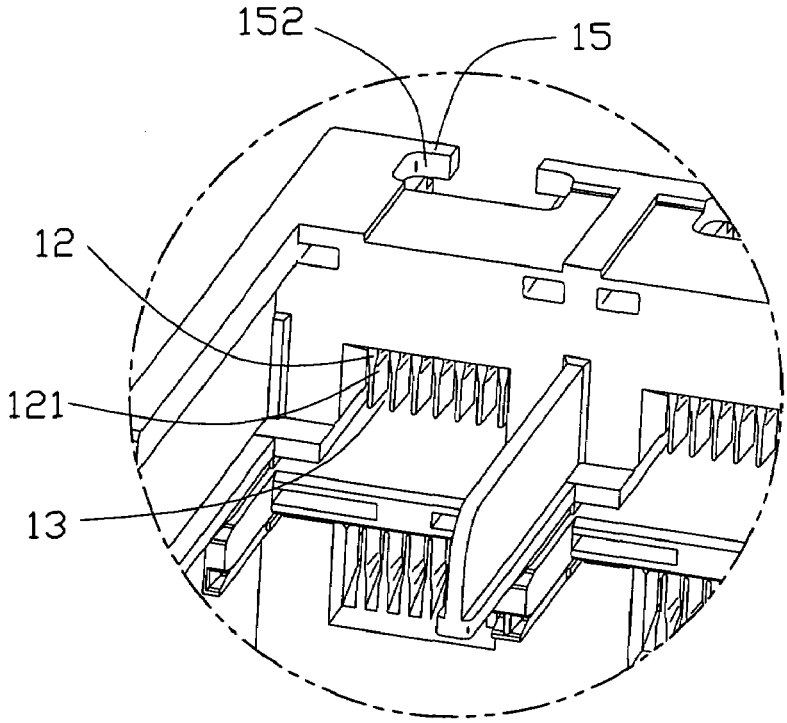
FIG. 10 is an alternate embodiment of the housing.
Figure 11:
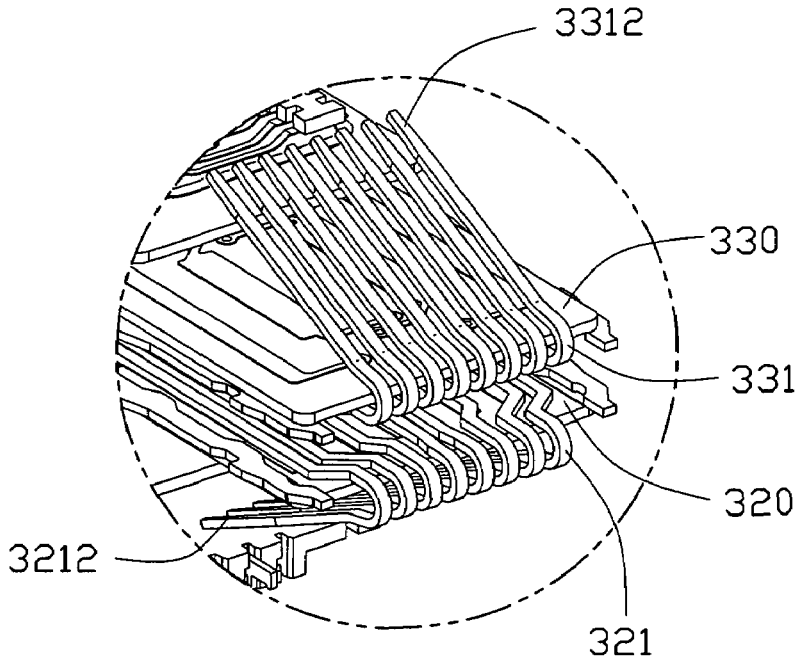
FIG. 11 is an alternate embodiment of contact arrays of the terminal block.

Although the preferred embodiment of the present invention only discloses the taper-shaped fingers 12, it can be understood that the fingers 12 could be designed with a decreased overall width. More, another alternate embodiment of the fingers 12 is best shown in FIG. 10. The fingers 12 are identical to that described above, with the exception of decreasing the depth of the fingers 12 relatively to rear face of a corresponding partition 11 such that increasing clearance defined between the contact engaging portion 3212, 3312 of each signal contact 321', 331' and corresponding slot 13 of the housing 1. In addition, modifying the fingers 12 could avoid the signal contacts 321', 331' binding, alternatively, modifying the signal contacts 321', 331', such as decreasing the width along overall length of the signal contacts 321', 331' or decreasing the width along length of the signal contacts 321', 331' that is only between the fingers 12, as best shown in FIG. 11, also could avoid the binding between the signal contacts 321', 331' and the fingers 12.

Figure 12:
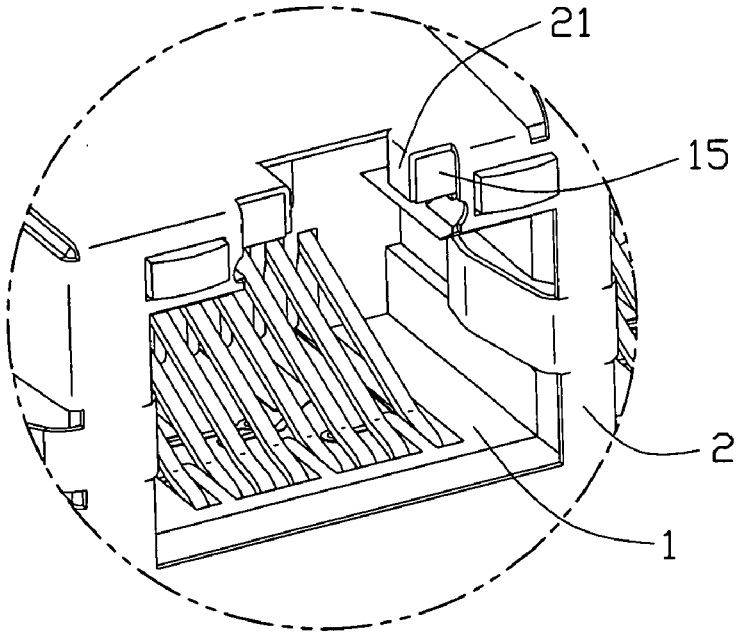
FIG. 12 is an alternate embodiment of a shield profiled to surround retention tabs of the housing for support protection.
Figure 13:
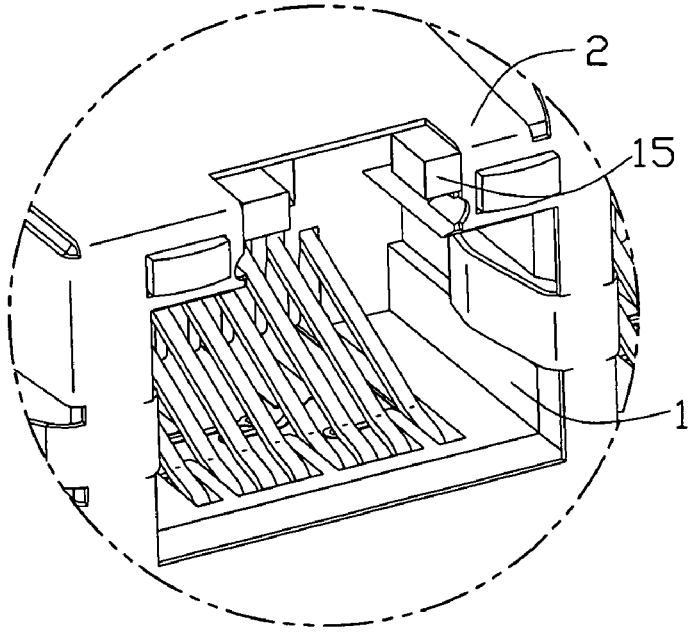
FIG. 13 is an alternate embodiment of the retention tabs of the housing extending forwardly for adding strength.

Although the preferred embodiment of the present invention only discloses the shielding blades 21 profiled to cover front face of the retention tabs 15. However, in alternative embodiments, extending and folding the shielding blades 21 into L-shaped configuration, as best shown in FIG. 12, to surround the retention tabs 15 can also design the shielding blades 21 for support protection. In addition, another alternative embodiment for support protection is best shown in FIG. 13. The shielding blades 21 are cut away and the front face of each retention tab 15 is added plastic such that the retention tabs are extending flush with or beyond the shield 2 for addition strength to the retention tabs 15.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack connector, comprising:

an insulative housing defining a cavity through a front face and a rear face;

a partition extending and arranged within the cavity defining a plug receiving space, the partition forming with a plurality of fingers and defining a plurality of slots between two adjacent fingers;

a plurality of terminals assembled to the housing, and having a contact engaging portion extending through the slots;

wherein each of the fingers includes a reduced-dimension-portion such that the slot between two adjacent fingers provides an additional space for movement of the contact engaging portion.

2. The modular jack connector as described in claim 1, wherein a pair of retention tabs formed on the housing and peripherally at each plug receiving space for latching a mating plug connector received therein.

3. The modular jack connector as described in claim 2, wherein a void is defined at rear joint behind each retention tab where two perpendicular surfaces intersect each other and said void has a cylindrical shape.

4. The modular jack connector as described in claim 2, wherein A void is defined at inside joint below each retention tab where two perpendicular surfaces intersect each other and said void has a cylindrical shape.

5. The modular jack connector as described in claim 2, wherein the modular jack connector comprises a shield shaped to enclose the housing and the shield has shielding blades profiled to cover front face of corresponding retention tabs for support protection.

6. The modular jack connector as described in claim 1, wherein the modular jack connector comprises a shield shaped to enclose the housing and the shield has shielding blades profiled to surround corresponding retention tabs for support protection.

7. The modular jack connector as described in claim 2, wherein front face of the retention tab extends forwardly such that flush with or beyond front face of the housing for adding strength.

8. The modular jack connector as described in claim 1, wherein the modular jack connector further comprises an LED module secured to the housing, the LED module including a carrier with leads overmolded therein and at least an LED electrically connecting with the leads.

9. A modular jack connector, comprising:

an insulative housing defining a cavity through a front face in a front-to-back direction;

a locking opening formed in a top face of the housing adjacent to the front face;

a pair of retention tabs located in front of the locking opening with a space between the pair of retention tabs in a transverse direction perpendicular to said front-to-back direction; and at least a pair of voids formed in one of first and second portions of the housing; wherein when said pair of voids are in the first portion, said voids extend in the front-to-back direction and respectively located adjacent to the corresponding retention tabs in a vertical direction perpendicular to both said front-to-back direction and said transverse direction; when said pair of voids are in the second portion, said voids extend in the vertical direction and respectively located adjacent to the corresponding retention tabs in the front-to-back direction, and wherein said voids each having a predetemined radius to enhance the retention tabs.

10. A modular jack connector, comprising:

an insulative housing defining a cavity through a front face and a rear face;

a partition extending and arranged within the cavity, the partition forming with a plurality of fingers and defining a plurality of slots between two adjacent fingers;

a plurality of terminals assembled to the housing, and having a contact engaging portion extending through the slots; wherein at least one of the fingers and the contact engaging portion includes a reduced-dimension-portion such that clearance between the contact engaging portion and the slot is increased.

11. The modular jack connector as described in claim 10, wherein the partition divides the cavity into a plug receiving space and a terminal receiving space respectively.

12. The modular jack connector as described in claim 10, wherein the plug receiving space is adapted for receiving a mating plug connector, means for securing the plug connector within the plug receiving space provided on the housing.

13. The modular jack connector as described in claim 12, wherein the means includes a pair of retention tabs formed on the housing and peripherally at each plug receiving space.

14. The modular jack connector as described in claim 13, wherein the housing defines at least a void at joint where two surfaces intersect each other of each retention tab.

15. A modular jack comprising:

an insulative housing defining a plurality of mating ports in rows and columns;

a plurality of first partitions respectively disposed between the adjacent two mating ports in a row direction;

a plurality of second partitions respectively disposed between the adjacent two mating ports in a column direction; and a plurality of terminal blocks arranged in the housing along the row direction with the first partition sandwiched between every adjacent two terminal blocks, each of said terminal blocks aligned, in a front-to-back direction, with the corresponding mating ports in only one row and including two opposite printed circuit boards respectively inserted into the corresponding two mating ports with the corresponding second partition sandwiched therebetween.

16. The modular jack as claimed in claim 15, wherein a plurality of LED modules are arranged in the housing along said row direction, and wherein said first partitions are shorter than a dimension of the housing along the front-to-back direction so as to allow each of the LED modules to extend in the row direction with a distance to align with the mating ports of the both two columns in the front-to-back direction.

17. The modular jack as claimed in claim 16, wherein said second partitions are shorter than the first partitions along the front-to-back direction so as to allow each of the terminal blocks to extend in a column direction with a distance to align with mating ports of the both two rows in the front-to-back direction.

* * * * *